US008172386B2

(12) United States Patent
Petranek et al.

(10) Patent No.: US 8,172,386 B2
(45) Date of Patent: May 8, 2012

(54) SEALING DEVICE FOR FLUID RESERVOIR

(75) Inventors: Diana C. Petranek, Hilton, NY (US); Douglas H. Pearson, Rochester, NY (US); Charles E. Follett, Rochester, NY (US); Mark D. Perkins, Wayland, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/013,936

(22) Filed: Jan. 26, 2011

(65) Prior Publication Data

US 2011/0115857 A1 May 19, 2011

Related U.S. Application Data

(63) Continuation of application No. 11/679,860, filed on Feb. 28, 2007, now Pat. No. 7,967,426.

(51) Int. Cl.
*B41J 2/175* (2006.01)
*B41J 2/17* (2006.01)

(52) U.S. Cl. ..... 347/86; 347/84; 347/85; 347/87

(58) Field of Classification Search ..... 347/84–87
See application file for complete search history.

(56) References Cited

U.S. PATENT DOCUMENTS

| | | | | |
|---|---|---|---|---|
| 5,619,237 | A | 4/1997 | Inoue et al. | |
| 6,464,339 | B1 | 10/2002 | Ardito | |
| 6,623,104 | B1 | 9/2003 | Kotaki et al. | |
| 6,739,708 | B2 | 5/2004 | Studer et al. | |
| 6,796,646 | B2 | 9/2004 | Komplin et al. | |
| 7,029,091 | B2 | 4/2006 | Stellbrink et al. | |
| 2005/0151811 | A1 * | 7/2005 | Shimizu et al. | 347/86 |
| 2006/0012628 | A1 * | 1/2006 | Anderson et al. | 347/29 |

OTHER PUBLICATIONS

Eastman Kodak Company U.S. Appl. No. 11/614,147, filed Dec. 21, 2006, entitled: Printing Device Fluid Reservoir With Gripping Features, by Diana C. Petranek, et al.

Eastman Kodak Company U.S. Appl. No. 11/614,160, filed Dec. 21, 2006, entitled: Data Storage Device Mounting Arrangement for Printing Device, by R. Winfield Trafton, et al.

Eastman Kodak Company U.S. Appl. No. 11/614,125, filed Dec. 21, 2006, entitled: Printing Device Fluid Reservoir With Alignment Features, by R. Winfield Trafton, et al.

Eastman Kodak Company USSN: Unassigned, filed: concurrently herewith, Apr. 9, 2010 entitled: Ink Jet Ink Cartridge With Vented Wick, by Douglas H. Pearson, et al.

Eastman Kodak Company Docket No. 93510, USSN: Unassigned, filed: concurrently herewith, Feb. 28, 2007 entitled: Fluid Port Seal With Surface Having Channels, by Daniel G. Warren, et al.

* cited by examiner

*Primary Examiner* — Charlie Peng
*Assistant Examiner* — Hung Lam
(74) *Attorney, Agent, or Firm* — Eugene I. Shkurko

(57) ABSTRACT

A sealing device is disclosed that includes a latching feature configured to facilitate latching of the sealing device to a fluid reservoir; a first region configured to seal or substantially seal a fluid-discharge port on the fluid reservoir from fluid loss when the sealing device is latched to the fluid reservoir; and a second region configured to protect a circuit device on the fluid reservoir when the sealing device is latched to the fluid reservoir. Accordingly, the presently disclosed sealing device provides an effective solution to not only sealing the fluid-discharge ports on the fluid reservoir, but also protecting the circuit device.

18 Claims, 12 Drawing Sheets

SEALING DEVICE FOR FLUID RESERVOIR

CROSS REFERENCE TO RELATED APPLICATIONS

This application is a continuation of prior U.S. patent application Ser. No. 11/679,860, filed Feb. 28, 2007 now U.S. Pat. No. 7,967,426, which is hereby incorporated herein by reference in its entirety.

FIELD OF THE INVENTION

This invention pertains to a fluid reservoir having a sealing device configured to prevent loss of fluid from a port in the fluid reservoir, for example, during shipping or storage. In particular, this invention pertains to a sealing device configured to hold a seal region of the sealing device in place against the port.

BACKGROUND OF THE INVENTION

Fluid reservoirs, such as inkjet printer ink cartridges, commonly have one or more ports with an opening through which fluid is delivered during use. In order to prevent loss of fluid, for example, by spillage or evaporation during shipping or storage, it is common to provide a cap seal for the port or ports. For cases where the cap seal is a compressible material which needs to be pressed against the port, a sealing retainer may be used to provide the force to compress the seal and hold it in place.

Fluid-ejection printing devices, such as ink jet printers, commonly have at least one fluid reservoir, such as an ink cartridge, and a printhead chassis that supports the ink cartridge. In the case of ink jet printers, the ink cartridge may contain one or more fluid chambers that provide fluid to a printhead die. If the ink cartridge has more than one fluid chamber, each such chamber often retains ink of a different color for multi-color printing. On the other hand, if the ink cartridge has only a single fluid chamber, typically such chamber is used to retain a single ink such as black ink for black-and-white printing.

The printhead die contains nozzles that eject fluid from the ink cartridge onto a substrate and typically is connected directly or indirectly to the chassis. In order to form an image, the printhead die, along with the chassis and the ink cartridge, generally are moved by a printhead carriage in a lateral direction across a width of a substrate, such as paper, as fluid is ejected from the printhead die. After the printhead die forms a row-portion of the image along the width of the substrate, the substrate is advanced in a direction perpendicular to the lateral direction along a length of the substrate, so that the printhead die can form a subsequent row-portion of the image. This process of advancing the substrate for each row-portion is repeated until a next substrate is needed or the image is completed.

When a fluid chamber in the ink cartridge runs out of ink, a user is charged with the responsibility of removing the empty ink cartridge from the chassis and replacing it with a full ink cartridge. The task of replacing an ink cartridge must be simple and clean. For example, fluid should not be allowed to stain the user's hands. The design of the seal retainer must be such that it is easy to remove the seal retainer from the ink cartridge in such a way that the user's fingers do not come into contact with ink.

In addition, some designs of ink cartridges, or other types of fluid reservoirs, have a data storage device mounted on the reservoir. The data storage device tracks ink usage during printing, as well as other data such as ink type and manufacturing date of the reservoir. Recent commonly owned U.S. patent application Ser. No. 11/614,160, filed Dec. 21, 2006 by W. Trafton et al., describes a mounting arrangement in which the data storage device is mounted on a pedestal that protrudes from the reservoir body. An advantage of such an arrangement is that the pedestal may protrude into or through a corresponding opening in the body of the printhead chassis. In this way, electronic connection can be made from the data storage device on the ink cartridge directly to a connector on the printhead carriage, and optionally from there to electronics in the printer body. While such a mounting arrangement provides advantages when the ink cartridge is installed into the printer, the data storage device on the pedestal can be susceptible to damage if the ink cartridge is dropped. Furthermore, there are alignment features on the reservoir body that could also be damaged if the cartridge is dropped or otherwise mishandled.

Accordingly, a need in the art exists for a cap seal retainer solution that allows a user to simply and cleanly remove the a shipping cap seal from a new ink cartridge and also that provides protection to the data storage device, and optionally to one or more alignment features.

SUMMARY

The above-described problems are addressed and a technical solution is achieved in the art by a sealing device configured to seal a fluid-discharge port of a fluid reservoir for an ink jet printer, according to various embodiments of the present invention. According to an embodiment of the present invention, the sealing device includes a latching feature configured to facilitate latching of the sealing device to the fluid reservoir; a first region configured to seal or substantially seal the fluid-discharge port from fluid loss when the sealing device is latched to the fluid reservoir; and a second region configured to protect a circuit device, which may be a data storage device, on the fluid reservoir when the sealing device is latched to the fluid reservoir. Accordingly, protection of the circuit device exists whenever the sealing device is latched to the fluid reservoir. Because the circuit device needs protection when the fluid reservoir is not installed into a printhead chassis, and because the sealing device is configured to be latched to the fluid reservoir when the reservoir is not installed into the printhead chassis, the presently disclosed sealing device provides an effective solution to not only sealing the fluid-discharge ports on the fluid reservoir, but also protecting the circuit device.

In addition, the sealing device may further include a third region configured to protect an alignment feature on the fluid reservoir when the sealing device is latched to the fluid reservoir. In this regard, the presently disclosed sealing device also provides an effective solution for protecting alignment features of the fluid reservoir.

According to an embodiment of the present invention, the latching feature is a first latching feature, and the sealing device may further include a second latching feature configured to facilitate latching of the sealing device to the fluid reservoir, the second latching feature located on an opposite side of the sealing device as the first latching feature. In addition, the sealing device may further include a third latching feature configured to facilitate latching of the sealing device to the fluid reservoir, the third latching feature located on a same side of the sealing device as the second latching feature. Also, the second and third latching features may be located on or substantially on opposites ends of a same side of the sealing device.

According to an embodiment of the present invention, the second region may be configured to extend beyond the circuit device when the sealing device is latched to the fluid reservoir. In this regard, the second region may include an opening configured to provide access to the circuit device when the sealing device is latched to the fluid reservoir.

According to an embodiment of the present invention, the sealing device further includes a force reception region configured to receive an unlatching force, the unlatching force causing the sealing device to be unlatched from the fluid reservoir. The force reception region may be greater than approximately 2 cm from a surface on which the first region is located. In addition or in the alternative, the force reception region, upon receipt of the unlatching force, may be configured to cause the first region to move angularly away from a plane parallel to the first region when the sealing device is latched to the fluid reservoir. Also, the force reception region, upon receipt of the unlatching force, may be configured to cause the sealing device to pivot about an axis that runs through the first latching feature.

According to an embodiment of the present invention, the first region may include a compliant region configured to facilitate sealing or substantially sealing the fluid-discharge port from fluid loss when the sealing device is latched to the fluid reservoir. The compliant region may be formed of an elastomeric material and/or may be formed of a material different from another portion of the first region. The other portion of the first region may be formed by injection molding. Also, the first region may further include an opening, and the compliant region may protrude through the opening of the first region. The opening in the first region may be triangular or substantially triangular in shape.

According to an embodiment of the present invention, the sealing device may further include a fourth region located between the first latching feature and the first region. According to this embodiment, the first region resides within or substantially within a first plane, and the fourth region resides within or substantially within a second plane, such that the first plane and the second plane intersect, and the second plane, in a direction toward the first latching feature, is tilted away from a location in which the fluid reservoir is configured to reside when the sealing device is latched to the fluid reservoir.

In addition, the fourth region may include two arms having an opening between them. Such arms may approach the first latching feature, and may symmetrically or substantially symmetrically approach the first latching feature. Also, the arms may have a "U" shape.

According to an embodiment of the present invention, the first region is configured to seal a plurality of fluid-discharge ports in the fluid reservoir. In this case, the second region may be configured to extend beyond the circuit device when the sealing device is latched to the fluid reservoir, and the second region may include an opening configured to provide access to the circuit device when the sealing device is latched to the fluid reservoir. In this regard, the second region may include a first opening and a second opening, the second opening having a position and shape symmetrical or substantially symmetrical to the first opening.

In an embodiment where the first region is configured to seal a plurality of fluid-discharge ports in the fluid reservoir, the first region may include a wall configured to surround the fluid discharge ports. The wall may have a uniform or a substantially uniform height.

According to an embodiment of the present invention, the sealing device is symmetrical about a plane. The plane may pass through the first latch and a center or an approximate center of the first region.

According to an embodiment of the present invention, the first latching feature, the second latching feature, and the third latching feature may be located above the first region, wherein "above" is in a direction towards the fluid discharge port relative to the first region when the sealing device is latched to the fluid reservoir. Also, the first latching feature, the second latching feature, and the third latching feature may be formed along or substantially along a plane, said plane being parallel or substantially parallel to a plane in which the first region resides.

In addition to the embodiments described above, further embodiments will become apparent by reference to the drawings and by study of the following detailed description.

BRIEF DESCRIPTION OF THE DRAWINGS

The present invention will be more readily understood from the detailed description of exemplary embodiments presented below considered in conjunction with the attached drawings, of which.

It is to be understood that the attached drawings are for purposes of illustrating the concepts of the invention and may not be to scale.

DETAILED DESCRIPTION

Embodiments of the present invention pertain to a sealing device that not only seals fluid-ejection ports on a fluid reservoir, but also protects at least a circuit device on the fluid reservoir when the retainer is latched to the fluid reservoir. Although examples of the present invention are provided in the context of a fluid reservoir being an ink jet ink cartridge, it is to be understood that the invention is applicable more generally to sealing members for ports of fluid reservoirs.

Figure 1:
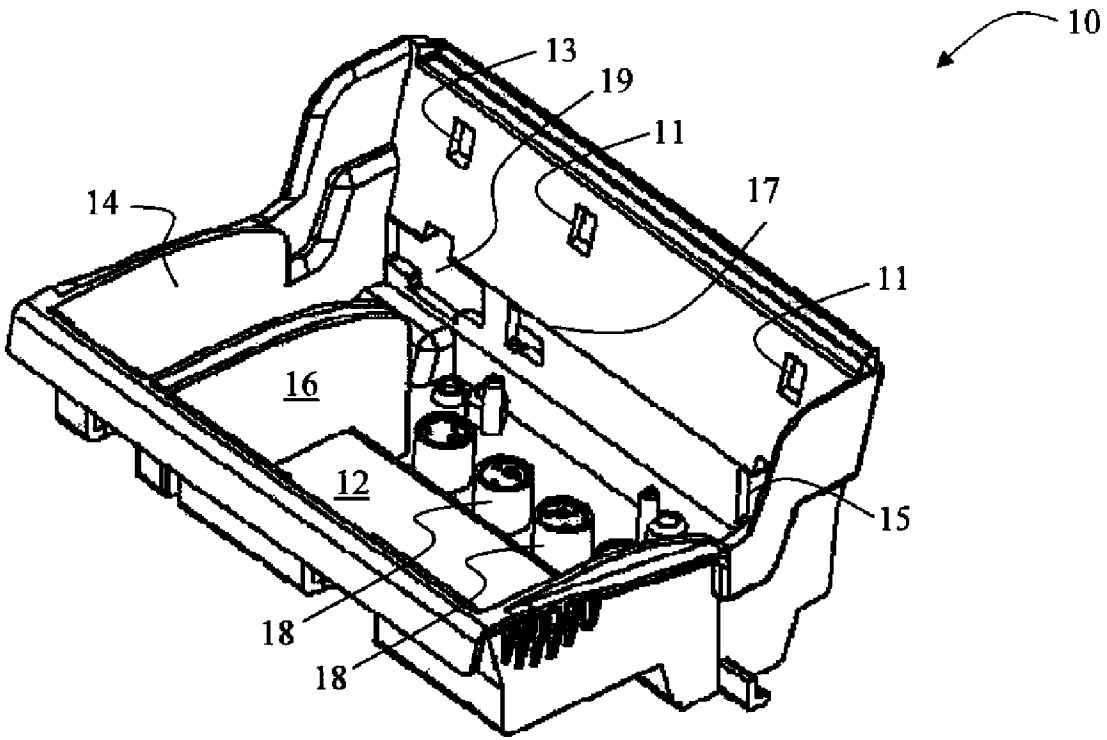
FIG. 1 illustrates a printhead chassis for retaining one or more print cartridges.

FIG. 1 illustrates a printhead chassis 10 having a region 12 for a multi-chamber ink cartridge, and also a region 14 for a single-chamber ink cartridge. Regions 12 and 14 are separated by one or more partitions 16 which also serve as guides for inserting the ink cartridges into the printhead chassis 10. In region 12, several fluid reception ports 18 are shown which make connection with the corresponding fluid discharge ports 24 (see, e.g., FIGS. 2 and 4) of a multi-chamber ink cartridge when the ink cartridge is inserted. Region 14 also has a single fluid reception port (hidden by partition 16) corresponding to the fluid discharge port of a single-chamber ink cartridge. Openings 11 in the printhead chassis wall receive corresponding protrusion alignment features of a first type 21 (see FIG. 2) from multi-chamber fluid reservoir 20 during the installation of the fluid reservoir into the printhead chassis, as described in commonly owned U.S. patent application Ser. No. 11/614,125, filed Dec. 21, 2006 by W. Trafton et al. Similarly, opening 13 in the printhead chassis wall receives a similar protrusion of a single chamber reservoir during installation. Opening 15 in printhead chassis wall (partially obscured in FIG. 1) receives a pedestal 31 of the multi-chamber reservoir 20, as well as protrusion alignment feature of a second type 23*a*. Opening 17 receives protrusion alignment feature of the second type 23*b* when fluid reservoir 20 is installed into the printhead chassis 10. Similarly, opening 19 receives a pedestal and alignment features from a single chamber reservoir when installed. Not shown in the view of FIG. 1, is the printhead die and its nozzles. Typically, the printhead die would be located underneath the printhead chassis, in a region below the fluid reception ports 18.

Figure 2:
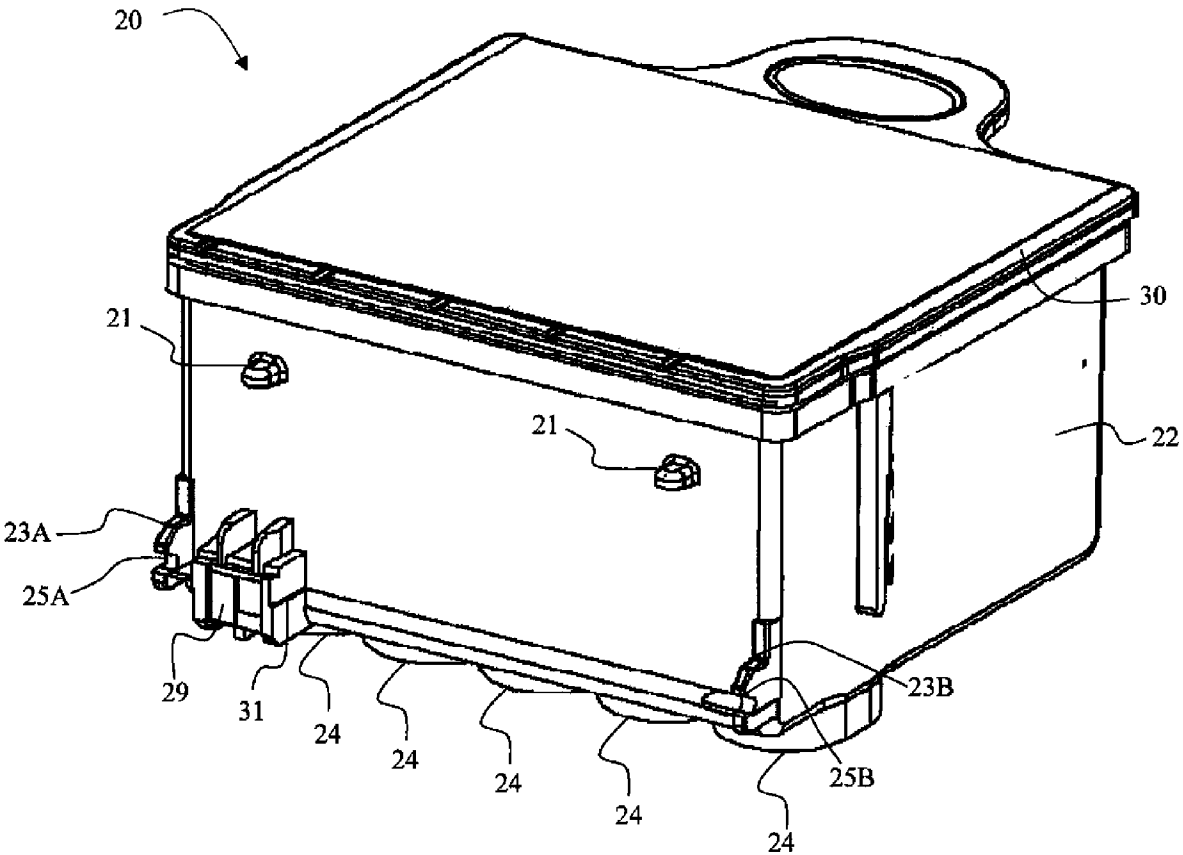
FIG. 2 shows an isometric view of a multi-chamber fluid reservoir.

FIG. 2 shows an isometric view of a multi-chamber fluid reservoir 20 which may be inserted into region 12 of printhead chassis 10. The particular fluid reservoir 20 shown in FIG. 2 has five chambers within reservoir body 22, each chamber of which leads to a fluid discharge port 24. The five chambers serve as reservoirs intended to hold five fluid sources. The five sources may be, for example, cyan ink, magenta ink, yellow ink, photo black ink, and a protective fluid. Alternatively, they may be cyan ink, light cyan ink, magenta ink, light magenta ink, and yellow ink; or they may be a different combination of fluids.

Fluid reservoir 20 is shown as having a lid 30 in the example shown in FIG. 2. Lid 30 is affixed to reservoir body 22. Typically, the lid 30 and the reservoir body 22 are each formed by injection molding. In addition to the other features described above (protrusion alignment features of the first type 21, pedestal 31, and protrusion alignment features of the second type 23*a* and 23*b*), also shown in FIG. 2 are circuit device 29 and latch catches 25*a* and 25*b*. Although not so limited, circuit device 29 may be a data storage device used to track the fluid usage from reservoir 20, and also may store data such as ink type, manufacturing date, etc. Latch catches 25*a* and 25*b* are attachment points for latches of the sealing device of this invention, as described below.

Figure 3:
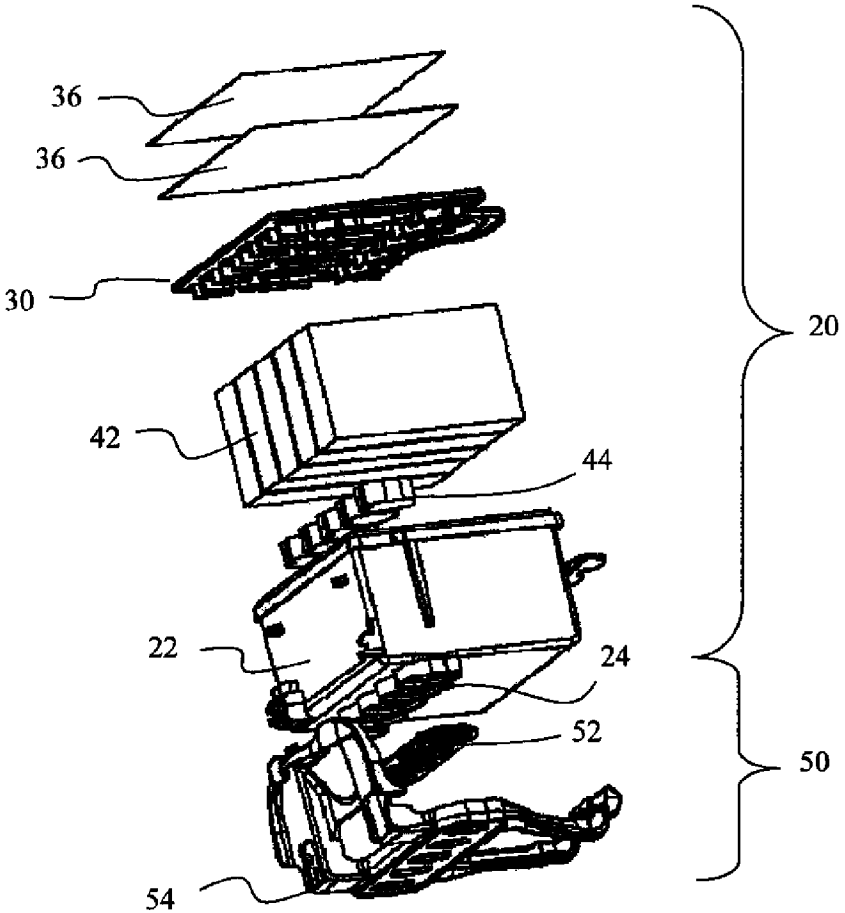
FIG. 3 shows an exploded view of a multi-chamber fluid reservoir and sealing device, according to an embodiment of the present invention.
Figure 7:
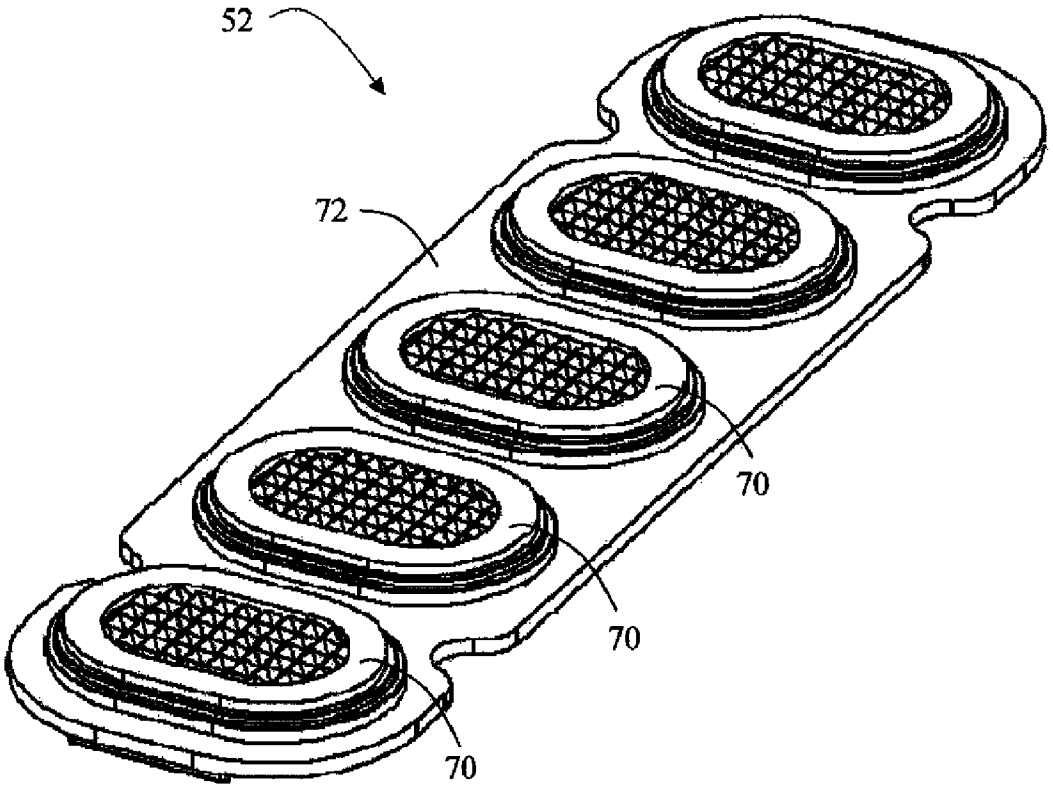
FIG. 7 shows an isometric view of a sealing member.

FIG. 3 shows an exploded view of the multi-chamber fluid reservoir 20, as well as sealing device 50. Sealing device 50 includes a compliant sealing member 52 which is held in place at the ports 24 by a retainer 54 of the present invention. Compliant sealing member 52 may be formed using a compressible material such as EPDM rubber or thermoplastic elastomer. FIG. 7 illustrates a particular implementation of the sealing member 52 that is described in greater detail in commonly owned U.S. patent application Ser. No. 11/679,892 titled, "Fluid Port Seal With Surface Having Channels," having and filed concurrently herewith by D. Pearson, et al. Retainer 54 may be formed by injection molding of a material such as polypropylene. For the particular example shown in FIG. 3, pressure regulation for the fluid reservoir is provided by capillary media 42 and wick 44, as is described in greater detail in commonly owned U.S. patent application Ser. No. 11/679,925 titled, "Ink Jet Ink Cartridge With Vented Wick," and filed concurrently herewith by D. Pearson, et al.

Lid 30 may be affixed to the reservoir body 22 by vibration welding or other means of adhering the lid to the reservoir body, such as ultrasonic welding. One or more labels 36 may be applied to the top surface of the lid 30. Ink or fluids of various types are typically held in the various chambers of the fluid reservoir.

Figure 4:
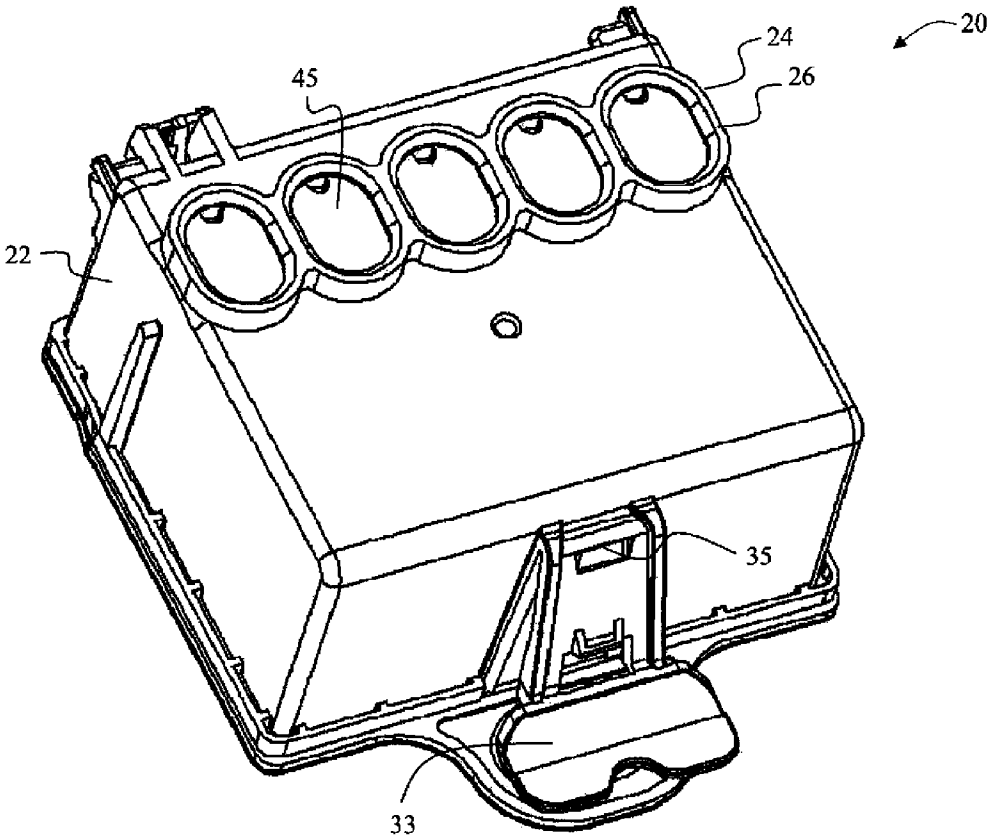
FIG. 4 shows a bottom view of a multi-chamber fluid reservoir.

FIG. 4 shows a bottom isometric view of the multi-chamber fluid reservoir 20 with the bottom surface 45 of each wick 44 visible within each port 24. Also shown in FIG. 4 is fluid reservoir latching lever 33 which engages with an opening in printhead chassis 10 when the fluid reservoir is installed, as described in commonly owned U.S. patent application Ser. No. 11/614,147, and filed Dec. 21, 2006 by D. Petranek, et al. Latching lever 33 extends from a wall of reservoir body 22. Near the position where latching lever 33 attaches to the wall, a latch catch 35 is provided in lever 33. Latch catch 35 is an attachment point for a latch of the retainer 54 of this invention as describe below.

Figure 5:
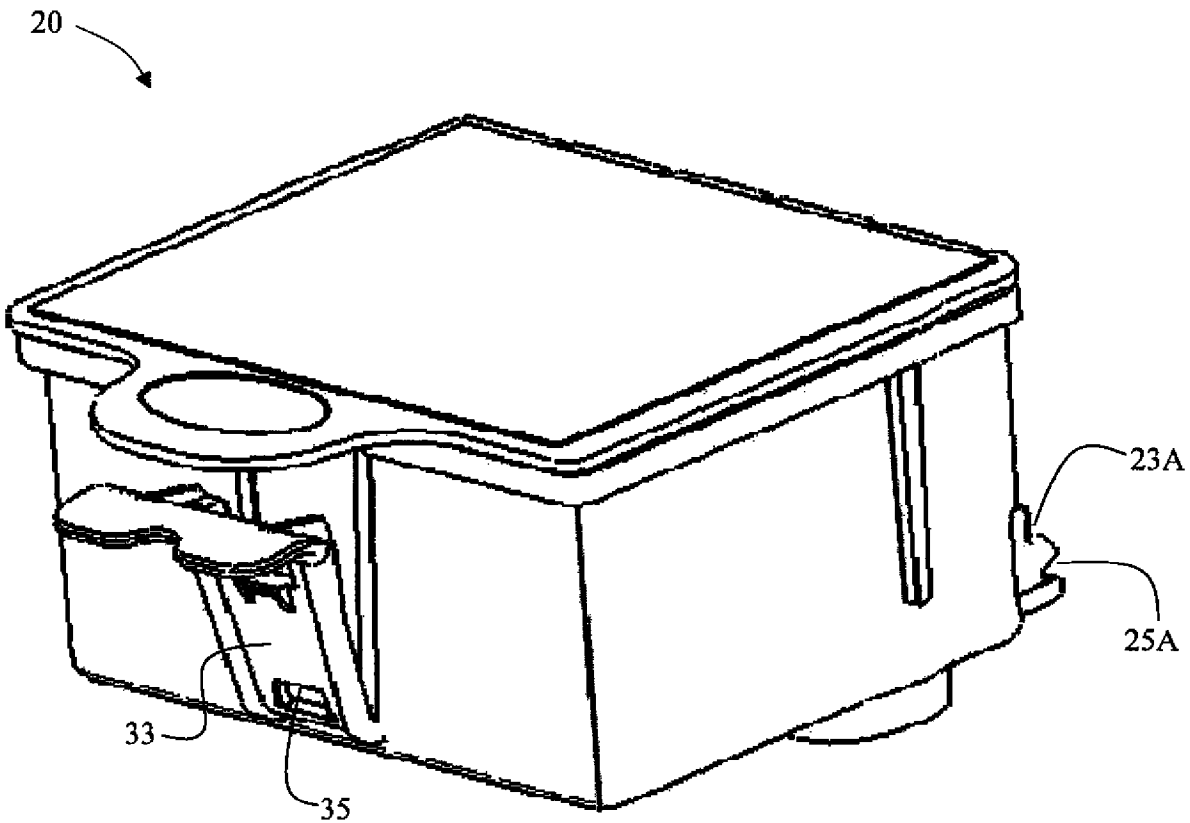
FIG. 5 shows an isometric view of a multi-chamber fluid reservoir.

FIG. 5 shows a top isometric view of the multi-chamber fluid reservoir 20. FIG. 5 shows a clearer view of the positional relationship between latch catch 35 in the fluid reservoir latching lever 33, relative to latch catch 25*a* which is located on an opposite side of the fluid reservoir from latch catch 35. A different view of the protrusion alignment feature of the second type 23*a* is also shown.

Figure 6:
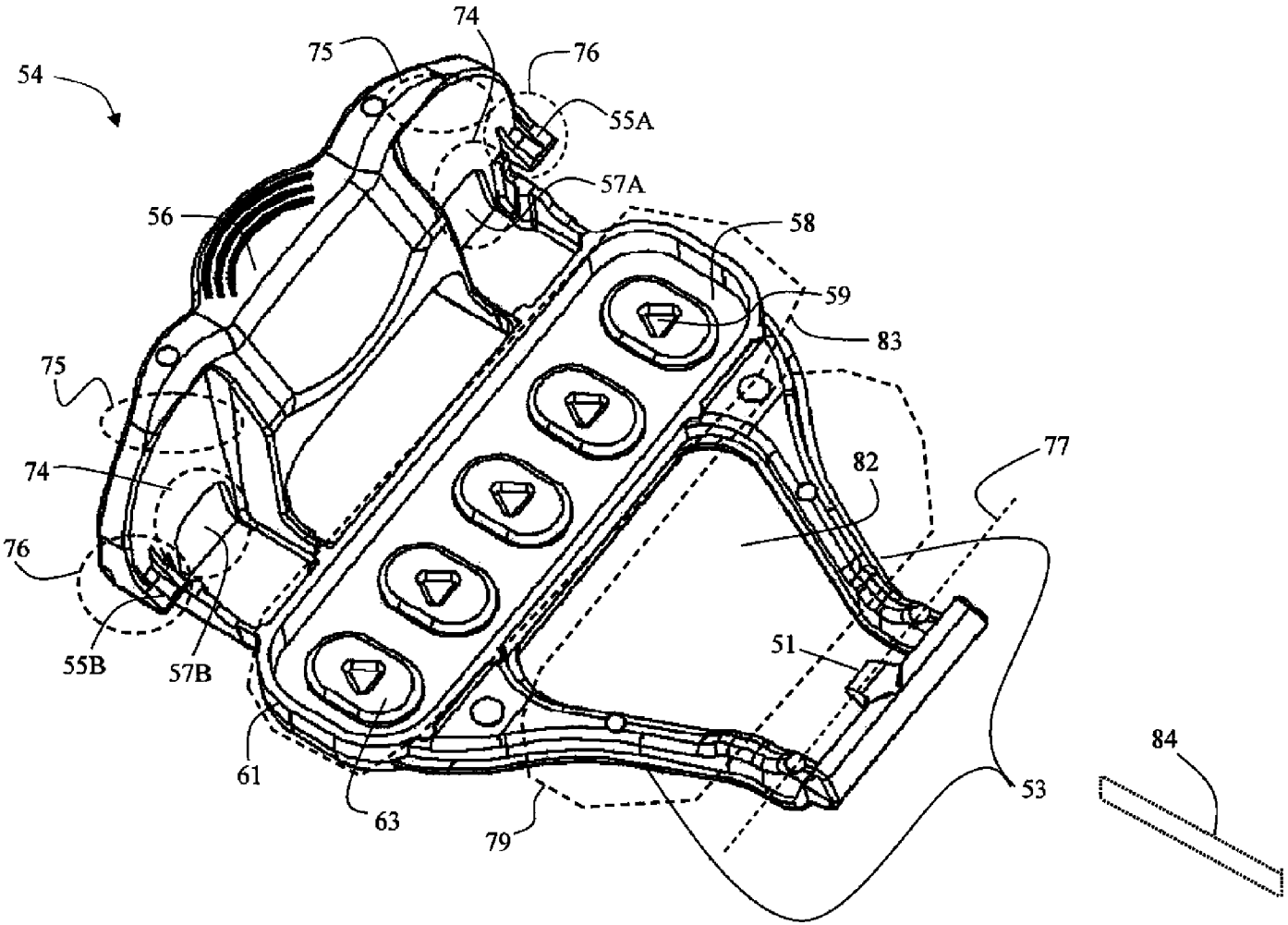
FIG. 6 shows an isometric view of a sealing device for a multi-chamber reservoir, according to an embodiment of the present invention.
Figure 11:
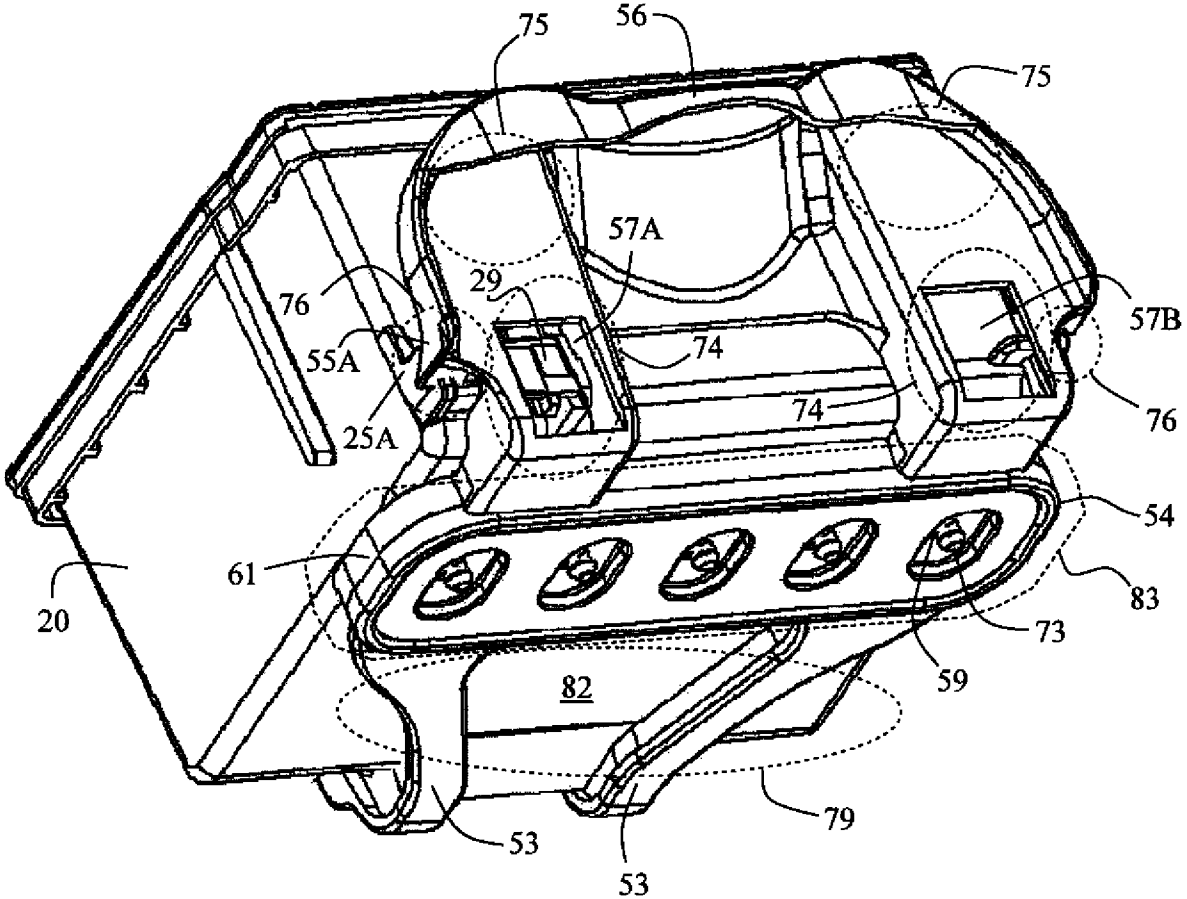
FIG. 11 shows an isometric view of a multi-chamber fluid reservoir with a sealing member held in place against the port openings by a sealing device, according to an embodiment of the present invention.

FIG. 6 shows a top isometric view of the retainer 54 portion of the sealing device 50, according to an embodiment of this invention. The sealing region 83 of the retainer 54 that is surrounded by wall 61 is configured to hold compliant sealing member 52 (not included in FIG. 6) for a fluid reservoir having five ports. In some embodiments, wall 61 is configured with a uniform height, although this is not a requirement of the invention. The sealing region 83 has a bottom surface 58 which holds the base 72 of the sealing member 52, as well as five raised portions 63 which provide support for the corresponding five individual port seals 70 on the sealing member 52 (see FIG. 7). Within each of the raised portions 63, a hole 59 is provided. This hole 59 is configured to retain a protuberance 73 (see FIG. 11) from the backside of the base 72 of sealing member 52. Although not required, the hole 59 may have a triangular shape, as shown in FIG. 6. The interference fit of the five protuberances 73 in the corresponding triangular holes 59 provides alignment of the sealing member 52, as well as securing it into the retainer 54.

FIG. 6 also shows three latching features on the retainer 54 to secure the retainer 54 onto fluid reservoir 20. The first latching feature 51 is configured to be inserted into latch catch 35 on fluid reservoir 20. The second latching feature 55*a* is located on the opposite side of the retainer 54 as latching feature 51, and is configured to be held by latch catch 25*a* on fluid reservoir 20. The third latching feature 55*b* is located on the same side of the retainer 54 as is latching feature 55*a*, and is configured to be held by latch catch 25*b*.

When sealing member 52 is installed into the sealing region 83 of the retainer 54, and when the retainer 54 is latched in place on fluid reservoir 20 (as in FIGS. 9, 10 and 11), the latching features 51, 55*a*, and 55*b* provide a securing force and also provide an upward force on the sealing member 52 so that its port seals 70 are pressed against the corresponding ports 24 of fluid reservoir 20.

Figure 9:
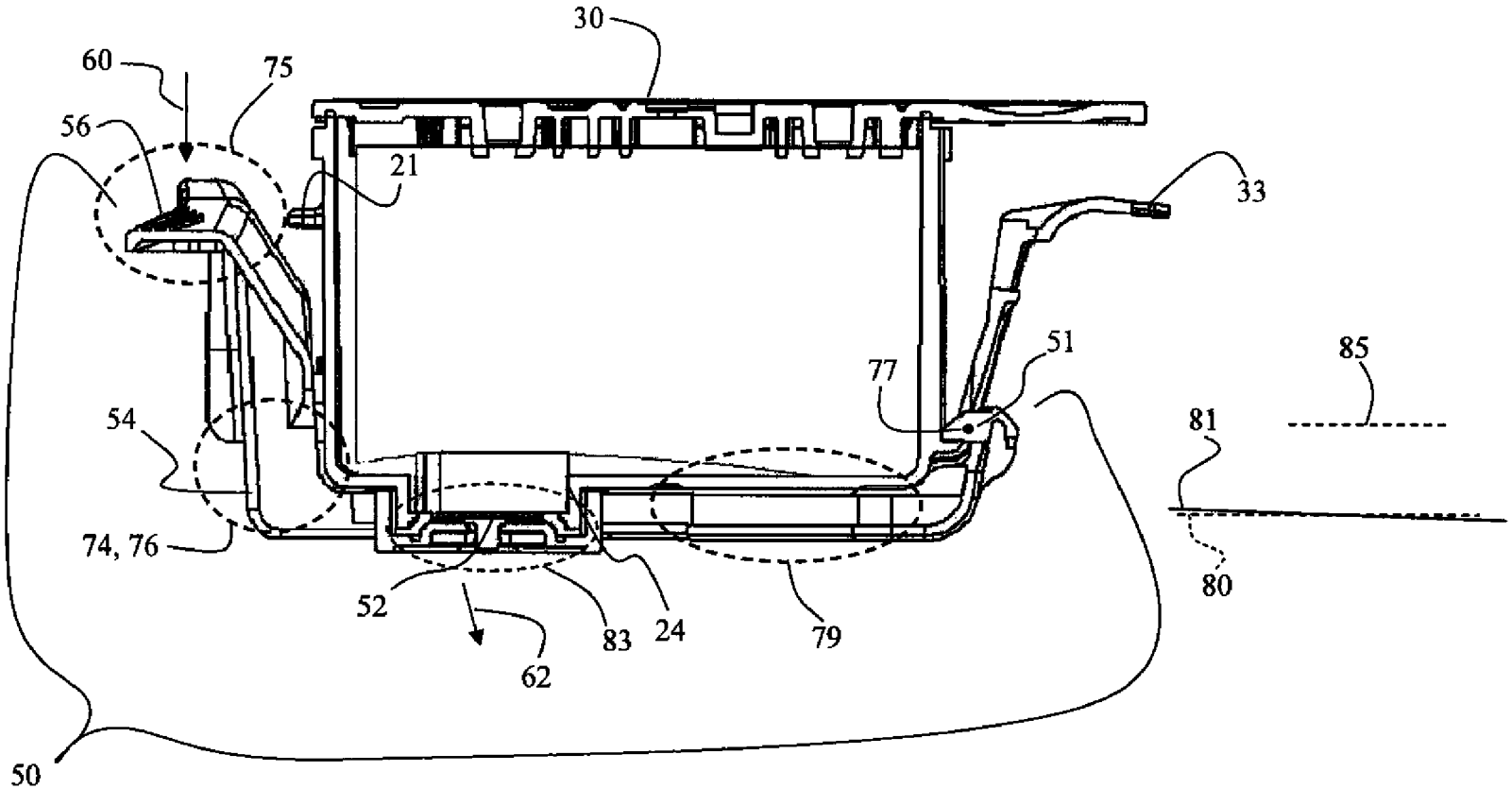
FIG. 9 shows a side view of a multi-chamber fluid reservoir with a sealing member held in place against a port opening by a sealing device, according to an embodiment of the present invention.
Figure 10:
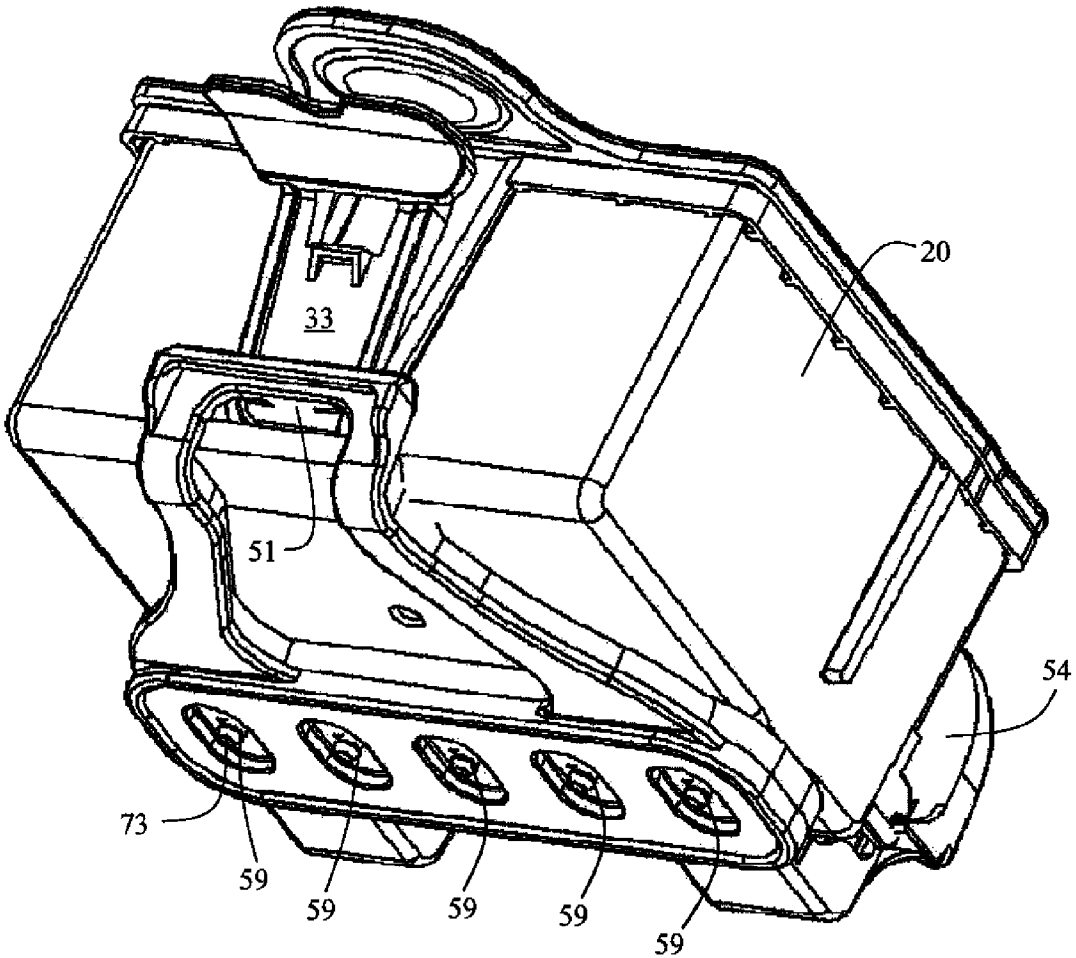
FIG. 10 shows an isometric view of a multi-chamber fluid reservoir with a sealing member held in place against the port openings by a sealing device, according to an embodiment of the present invention.

To assist in providing these securing and upward forces, the seal region 83 may be located within a first plane 80 (shown in FIG. 9), and a region 79 located between the latching feature 51 and the seal region 83 may be located within a second plane 81 (shown in FIG. 9). In this case, the first plane 80 and the second plane 81 may intersect, and the second plane 81, in a direction toward the first latching feature 51, may be tilted or biased away from a location in which the fluid reservoir is configured to reside when the sealing device is latched to the fluid reservoir (see FIG. 9). This tilting or biasing may be present both when the retainer 54 is secured to the fluid reservoir 20 and when the retainer 54 is not secured to the fluid reservoir 20. Such tilting or biasing causes a biasing force to facilitate pressing of the port seals 70 against the corresponding ports 24 of fluid reservoir 20, thereby improving sealing of the ports 24. However, such a biasing force should not be excessive, such that removing the retainer 54 from the fluid reservoir 20 is difficult.

Further in this regard, the latching features 51, 55*a*, and 55*b* may be located above the seal region 83, where "above" is in a direction towards the fluid discharge port relative to the first region when the sealing device is latched to the fluid reservoir. Having the latching features 51, 55*a*, and 55*b* above the seal region 83 further facilitates the provision of the biasing force.

Still further in this regard, the latching features 51, 55*a*, and 55*b* may be formed along or substantially along a plane 85 (shown in FIG. 9). The plane 85 is parallel or substantially parallel to the plane 80 to facilitate providing a balanced biasing force.

Further, the region 79 may include two arms 53 with an opening 82 therebetween. The two arms 53 may symmetrically or substantially symmetrically approach latching feature 51. In addition, although not shown in the figures, the arms 53 may have a "U" shape when viewed along a cross-section parallel to axis 77. Forming region 79 with arms 53, as opposed to forming a solid region, can reduce manufacturing costs, and provide an appropriate distribution of forces on the sealing member 52 when latched, without requiring excessive force to unlatch retainer 54. In addition, forming the arms 53 in a "U" shape can provide further benefits for these same reasons. Forming the arms 53 to extend symmetrically or substantially symmetrically towards the latching feature 51 can facilitate providing a balanced biasing force to press the port seals 70 against the corresponding ports 24.

Further in regard to a balanced biasing force and reduced manufacturing costs, the sealing device 50 may be formed symmetrically or substantially symmetrically about a plane 84 that bisects the sealing device 54 in a direction perpendicular to the plane 80 in which the seal region 83 resides.

As shown in FIG. 6, the latching features 55*a* and 55*b* may be located on opposite ends of the same side of the retainer 54 and may be positioned approximately as far apart as the outer edges of the two endmost raised portions 63, so that the outermost two port seals 70, as well as the inner three port seals, are equally or substantially equally pressed into contact with the corresponding fluid ports 24.

Also shown in FIG. 6 are two regions 74 of the retainer 54 which are located near latching features 55*a* and 55*b* in this embodiment. One of these regions is near opening 57*a*. This region extends in front of the circuit device 29 and pedestal 31 when the sealing device 50 is latched onto fluid reservoir 20. The other region 74 is near opening 57*b*, which is provided in order to preserve the symmetry of retainer 54 so that an appropriate distribution of force is applied to seal member 52 for each of the port seals 70. The region 74 near opening 57*b* also may extend in front of an optional second circuit device, in the event that another circuit device is present. Accordingly, the region 74 near the opening 57*b* would extend in front of such other circuit device when the sealing device 50 is latched onto the fluid reservoir 20. The regions 74 provide mechanical protection for the circuit device(s) in the event that the fluid reservoir 20 is dropped prior to being installed in the printhead chassis 10.

Openings 57*a*, 57*b* are optionally provided in order to allow electrical contact to be made with the circuit device 29 and another circuit device while the sealing device 50 is latched to the fluid reservoir 20. Such an arrangement allows, among other things, reading of the circuit device 29 while the fluid reservoir 20 is not loaded into the printhead chassis 10 and while the sealing device 50 is latched to the fluid reservoir.

Regions 75 (see FIGS. 6 and 9, for example), according to an embodiment of the present invention, are configured to mechanically protect the protrusion alignment features of the first type 21 when the sealing device 50 is latched to the fluid reservoir 20. Further in this regard, regions 76 (see FIGS. 6 and 11, for example) may be configured to mechanically protect the protrusion alignment features of the second type 23 when the sealing device 50 is latched to the fluid reservoir 20. Consequently, alignment features may be protected from damage which might compromise their ability to provide adequate alignment of the fluid reservoir 20 into printhead chassis 10.

Figure 8:
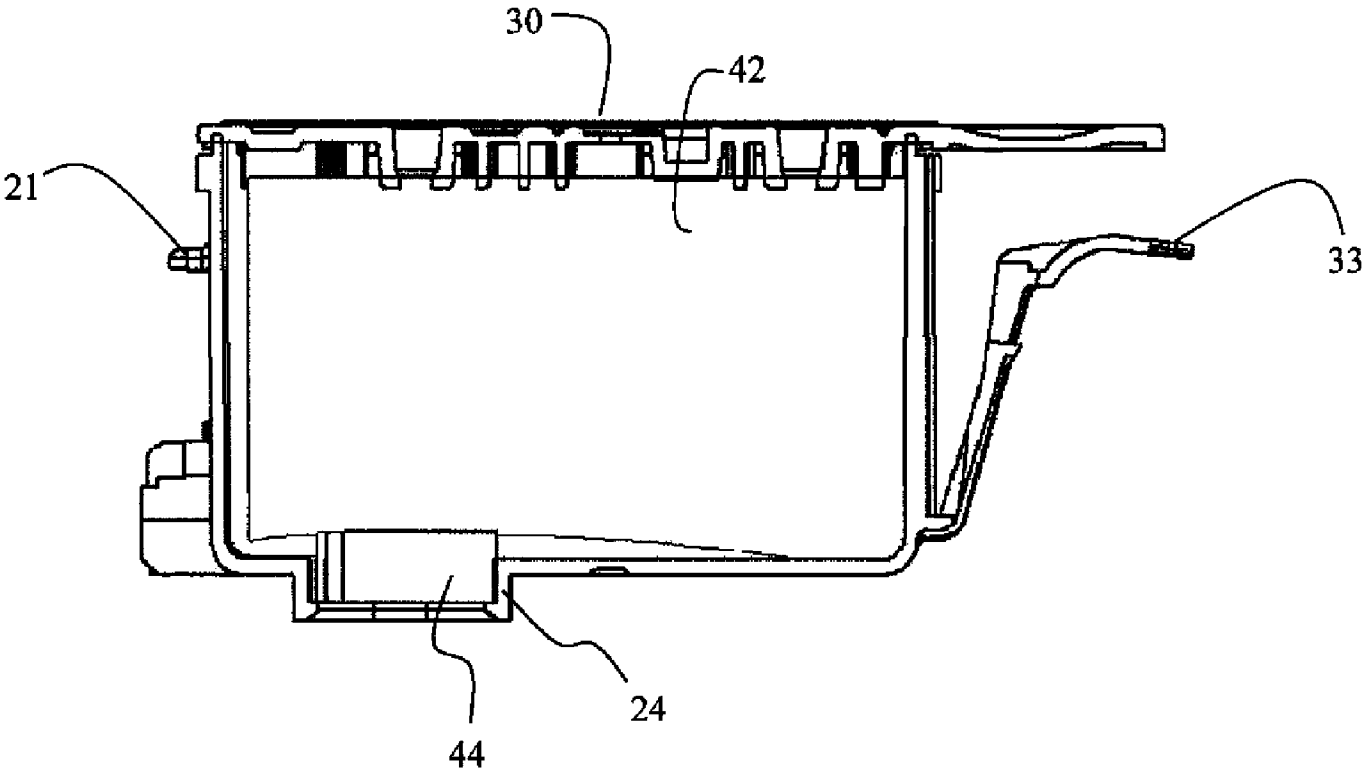
FIG. 8 shows a side view of a multi-chamber fluid reservoir.

FIG. 8 shows a cutaway side view of fluid reservoir 20 without sealing device 50 latched thereto. By comparing this figure with the side view of FIG. 9 of the fluid reservoir 20 with sealing device 50 latched thereto, it may be clearer to see which parts are associated with the fluid reservoir, and which parts are associated with the sealing device 50. Sealing member 52 is shown pressed against port 24 and held in place by the retainer 54. In order to remove the retainer 54, the user applies an unlatching force on the force reception region of sealing device lever 56 in a downward direction denoted by arrow 60, which releases latching features 55*a* and 55*b* from latch catches 25*a* and 25*b*. At this time, latching feature 51 is still engaged in latch catch 35. As a result, the retainer 54 pivots around an axis 77 (see FIG. 6) running through latching feature 51, so that the sealing member 52 is pulled away from outer rim 26 of fluid discharge port 24 in a direction denoted by arrow 62, at an angle from the plane 80 (shown in FIG. 9). Then the latching feature 51 can be easily removed from latch catch 35. The force reception region of sealing device lever 56 may be located approximately 2 cm or more away from surface 58 of the region where the sealing member 52 is located. Such an arrangement may help to keep a user's fingers away from the fluid ports 24 of the fluid reservoir 20, and also may provide a suitable extension of region 75 of the retainer 54 that extends in front of the protrusion alignment features of the first type 21.

Figure 12:
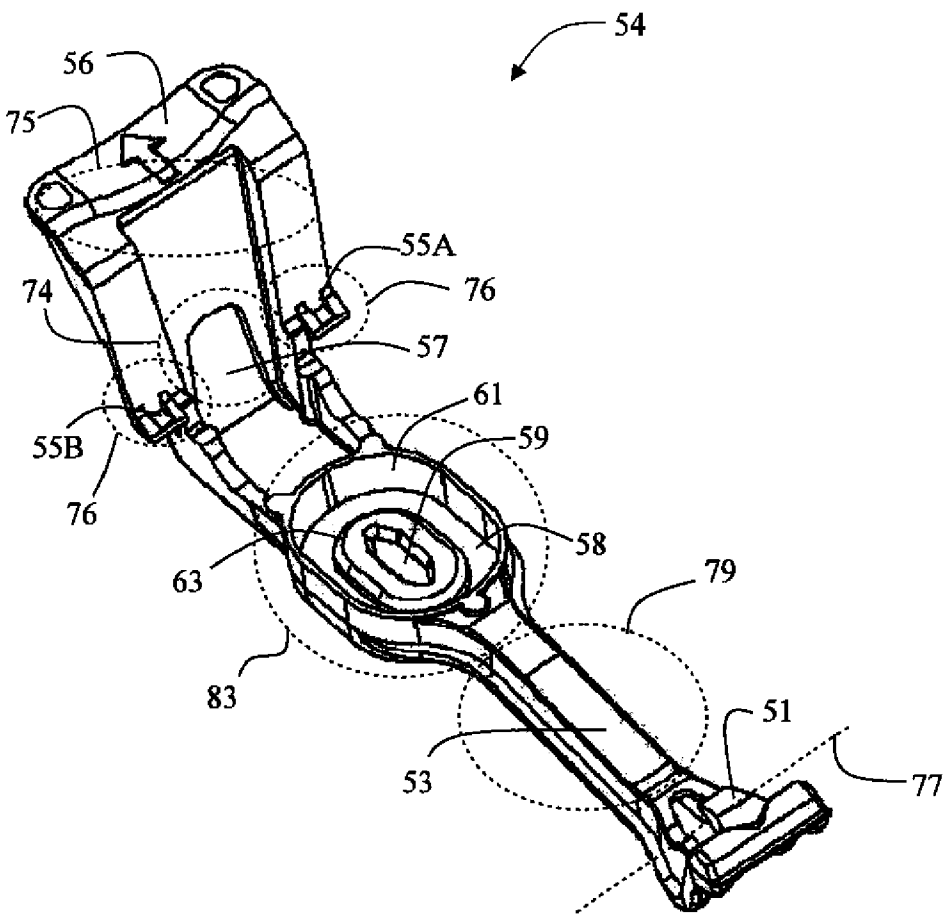
FIG. 12 shows an isometric view of a sealing device for a single chamber reservoir, according to an embodiment of this invention.

Although the examples above discuss embodiments of a sealing device for a multi-chamber fluid reservoir 20, it is to be understood that at least many of the same considerations and advantages apply to a single chamber fluid reservoir. In this regard, FIG. 12 shows an embodiment of a sealing device retainer 54 for a single chamber reservoir. The same or similar design features are referred to by the same reference numerals as discussed with respect to the multi-chamber embodiments. A few features have the similar function to their multi-chamber sealing device counterparts, but different design. For example, although not required, only one arm 53 may be provided for the single-chamber sealing device example shown in FIG. 12. In addition, the hole 59 for holding protuberance 73 from the backside of sealing member base 72 may be elongated in the single-chamber sealing device example. This elongated hole 59 and corresponding elongated protuberance 73 may provide greater holding force for the case of a single port seal 70, and may also provide better alignment of sealing member 52 than a single circular protuberance 73 would.

It is to be understood that the exemplary embodiments are merely illustrative of the present invention and that many variations of the above-described embodiments can be devised by one skilled in the art without departing from the scope of the invention. It is therefore intended that all such variations be included within the scope of the following claims and their equivalents.

PARTS LIST

10 Printhead chassis
11 Opening in chassis wall
12 Region for multi-chamber cartridge
13 Opening in chassis wall
14 Region for single chamber cartridge
15 Opening in chassis wall
16 Partition
17 Opening in chassis wall
18 Fluid reception port
19 Opening in chassis wall
20 Multi-chamber ink cartridge/fluid reservoir
21 Protrusion alignment feature of a first type
22 Reservoir body
23 Protrusion alignment feature of a second type
24 Fluid discharge port
25 Latch catch
26 Outer rim of fluid discharge port
29 Circuit device
30 Lid
31 Pedestal
33 Fluid reservoir latching lever
35 Latch catch
36 Label
42 Capillary media
44 Wick
45 Bottom surface of wick
46 Wick opening
50 Sealing device
51 Latching feature
52 Sealing member
53 Arm
54 Retainer
55 Latching feature
56 Sealing device lever/Force reception region
57 Opening in retainer 54
58 Bottom surface of seal region
59 Hole for retaining protuberance
60 Arrow
61 Wall around seal region
62 Direction arrow
63 Raised portion of seal region
70 Port seal
72 Sealing member base
73 Protuberance
74 Protection region for the circuit device 29
75 Protection region for protrusion alignment feature of the first type 21
76 Protection region for protrusion alignment feature of the second type 23
77 Axis through latching feature 51
79 Region between latching feature 51 and seal region 83
80 Plane in which the seal region 83 resides
81 Plane in which the region 79 resides
82 Opening in the region 79
83 Seal region
84 Plane bisecting the retainer 54
85 Plane in which latching features 51, 55 reside

The invention claimed is:

1. A sealing device configured to seal a fluid-discharge port of a fluid reservoir for an ink jet printer, the sealing device comprising:

a latch configured to be inserted into a latch catch disposed on the fluid reservoir for latching the sealing device to the fluid reservoir;

a first region configured to seal or substantially seal the fluid-discharge port from fluid loss when the sealing device is latched to the fluid reservoir; and a second region configured to protect a circuit device on the fluid reservoir when the sealing device is latched to the fluid reservoir, the second region including an opening over the circuit device to allow electrical contact to the circuit device through the opening when the sealing device is latched to the fluid reservoir.

2. The sealing device of claim 1, further comprising a third region configured to protect an alignment feature on the fluid reservoir when the sealing device is latched to the fluid reservoir.

3. The sealing device of claim 1, wherein the latch is a first latch, and the sealing device further comprises a second latch configured to facilitate latching of the sealing device to the fluid reservoir, the second latch located on an opposite side of the sealing device as the first latch.

4. The sealing device of claim 1, wherein the second region is configured to extend beyond the circuit device when the sealing device is latched to the fluid reservoir.

5. The sealing device of claim 1, wherein the first region includes a compliant region configured to facilitate sealing or substantially sealing the fluid-discharge port from fluid loss when the sealing device is latched to the fluid reservoir.

6. The sealing device of claim 5, wherein the compliant region is formed of a material different from another portion of the first region.

7. The sealing device of claim 6, wherein the compliant region is formed of an elastomeric material.

8. The sealing device of claim 7, wherein the first region further comprises an opening, and wherein the compliant region protrudes through the opening of the first region.

9. The sealing device of claim 3, further comprising a third region located between the first latch and the first region, wherein the first region resides within or substantially within a first plane, and the third region resides within or substantially within a second plane, such that the first plane and the second plane intersect, and the second plane, in a direction toward the first latch, is tilted away from a location in which the fluid reservoir is configured to reside when the sealing device is latched to the fluid reservoir.

10. The sealing device of claim 1 wherein the first region is configured to seal a plurality of fluid-discharge ports in the fluid reservoir.

11. The sealing device of claim 10, wherein the second region is configured to extend beyond the circuit device when the sealing device is latched to the fluid reservoir.

12. The sealing device of claim 11, wherein the opening is a first opening, and wherein the second region further includes a second opening having a position and shape symmetrical or substantially symmetrical to the first opening.

13. The sealing device of claim 10, wherein the first region comprises a wall configured to surround the fluid discharge ports.

14. The sealing device of claim 10, wherein the wall has a uniform or a substantially uniform height.

15. The sealing device of claim 10, wherein the sealing device is symmetrical about a plane.

16. The sealing device of claim 15, wherein the plane passes through the first latch and a center or an approximate center of the first region.

17. The sealing device of claim 4, wherein the first latch and the second latch are located above the first region, wherein "above" is in a direction towards the fluid discharge port relative to the first region when the sealing device is latched to the fluid reservoir.

18. The sealing device of claim 17, wherein the first latch and the second latch are formed along or substantially along a plane, said plane being parallel or substantially parallel to a plane in which the first region resides.

* * * * *